US005259946A

United States Patent [19]

Robinson et al.

[11] Patent Number: 5,259,946

[45] Date of Patent: * Nov. 9, 1993

[54] SULFUR REMOVAL SYSTEM FOR PROTECTION OF REFORMING CATALYSTS

[75] Inventors: Richard C. Robinson, San Rafael; Robert L. Jacobson, Vallejo; Leslie A. Field, Emeryville, all of Calif.

[73] Assignee: Chevron Research and Technology Company, San Francisco, Calif.

[ * ] Notice: The portion of the term of this patent subsequent to May 3, 2005 has been disclaimed.

[21] Appl. No.: 953,192

[22] Filed: Sep. 29, 1992

Related U.S. Application Data

[63] Continuation of Ser. No. 488,103, Mar. 5, 1990, abandoned, which is a continuation of Ser. No. 166,588, Mar. 10, 1988, Pat. No. 4,925,549, which is a continuation of Ser. No. 667,505, Oct. 31, 1984, Pat. No. 4,741,819.

[51] Int. Cl.[5] ..... C10G 35/06

[52] U.S. Cl. ..... 208/65; 208/62; 208/66; 208/89; 208/99; 208/212

[58] Field of Search ..... 208/62, 65, 66, 89, 208/99, 212

[56] References Cited

U.S. PATENT DOCUMENTS 4,741,819 5/1988 Robinson et al. ..... 208/212
4,925,549 5/1990 Robinson et al. ..... 208/65

*Primary Examiner*—Helane Myers
*Attorney, Agent, or Firm*—Burns, Doane, Swecker & Mathis

[57] ABSTRACT

A process for removing residual sulfur from a hydrotreated naphtha feedstock is disclosed. The feedstock is contacted with molecular hydrogen under reforming conditions in the presence of a less sulfur sensitive reforming catalyst, thereby converting trace sulfur compounds to $H_2S$, and forming a first effluent. The first effluent is contacted with a solid sulfur sorbent, removing the $H_2S$ and forming a second effluent. The second effluent is contacted with a highly selective reforming catalyst under severe reforming conditions.

1 Claim, No Drawings

SULFUR REMOVAL SYSTEM FOR PROTECTION OF REFORMING CATALYSTS

This application is a continuation of application Ser. No. 488,103 filed Mar. 5, 1990 now abandoned which is a continuation of Ser. No. 07/166,588, filed Mar. 10, 1988, now U.S. Pat. No. 4,925,549, which, in turn, is a continuation of application Ser. No. 667,505, filed Oct. 31, 1984, now U.S. Pat. No. 4,741,819.

BACKGROUND OF THE INVENTION

This invention relates to the removal of sulfur from a hydrocarbon feedstock particularly the removal of extremely small quantities of thiophene sulfur.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds. The sulfur in aromatic sulfur-containing ring compounds will be herein referred to as "thiophene sulfur".

Conventionally, feeds with substantial amounts of sulfur, for example, those with more than ppm sulfur, are hydrotreated with conventional catalysts under conventional conditions, thereby changing the form of most of the sulfur in the feed to hydrogen sulfide. Then the hydrogen sulfide is removed by distillation, stripping or related techniques. Such techniques can leave some traces of sulfur in the feed, including thiophenic sulfur, which is the most difficult type to convert.

Such hydrotreated naphtha feeds are frequently used as feed for catalytic dehydrocyclization also known as reforming. Some of these catalysts are extremely sulfur sensitive, particularly those that contain zeolitic components. Others of these catalysts can tolerate sulfur in the levels found in typical reforming feeds.

One conventional method of removing residual hydrogen sulfide and mercaptan sulfur is the use of sulfur sorbents. See for example U.S. Pat. Nos. 4,204,997 and 4,163,708, both R. L. Jacobson and K. R. Gibson. The concentration of sulfur in this form can be reduced to considerably less than 1 ppm by the use of the appropriate sorbent and conditions, but it is difficult to remove sulfur to less than 0.1 ppm or to remove any residual thiophene sulfur. See for example U.S. Pat. No. 4,179,361 by M. J. Michlmayr, and particularly Example 1 in that Patent. In particular, very low space velocities are required, to remove thiophene sulfur, requiring large reaction vessels filled with sorbent, and even with these precautions, traces of thiophene sulfur can get through.

It would be advantageous to have a process to remove most sulfur, including thiophene sulfur, from a reforming feedstream.

SUMMARY OF THE INVENTION

This invention provides a method for removing residual sulfur from a hydrotreated naphtha feedstock comprising:

(a) contacting the feedstock with hydrogen under mild reforming conditions in the presence of a less sulfur sensitive reforming catalyst, thereby carrying out some reforming reactions and also converting trace sulfur compounds to $H_2S$ and forming a first effluent;

(b) contacting said first effluent with a solid sulfur sorbent, to remove the $H_2S$, thereby forming a second effluent which is ie: less than 0.1 ppm sulfur;

(c) contacting said second effluent with a highly selective reforming catalyst which is more sulfur sensitive under severe reforming conditions in subsequent reactors.

DETAILED DESCRIPTION

The naphtha fraction of crude distillate, containing low molecular weight sulfur-containing impurities, such as mercaptans, thiophene, and the like, is usually subjected to a preliminary hydrodesulfurization treatment. The effluent from this treatment is subjected to distillation-like processes to remove $H_2S$. The effluent from the distillation step will typically contain between 0.2 and 5 ppm sulfur, and between 0.1 and 2 ppm thiophene sulfur. This may be enough to poison selective sulfur sensitive reforming catalysts in a short period of time. So the resulting product stream, which is the feedstream to the reforming step, is then contacted with a highly efficient sulfur sorbent before being contacted with the sensitive reforming catalyst. Contacting this stream with a conventional sulfur sorbent removes most of the easily removed $H_2S$ sulfur and most of the mercaptans but tends to leave any unconverted thiophene sulfur. Sulfur sorbents that effectively remove thiophene sulfur require low space velocities; for example, liquid hourly space velocities of less than 1 hr. $^{-1}$ have been reported in actual examples.

FIRST REFORMING CATALYST

The first reforming catalyst is a less sulfur sensitive catalyst which is a Group VIII metal plus a promoter metal if desired supported on a refractory inorganic oxide metal. Suitable refractory inorganic oxide supports include alumina, silica, titania, magnesia, boria, and the like and combinations, for example silica and alumina or naturally occurring oxide mixtures such as clays. The preferred Group VIII metal is platinum. Also a promoter metal, such as rhenium, tin, germanium, iridium, rhodium, and ruthenium, may be present. Preferably, the less sulfur sensitive reforming catalyst comprises platinum plus a promoter metal such as rhenium if desired, an alumina support, and the accompanying chloride. Such a reforming catalyst is discussed fully in U.S. Pat. No. 3,415,737, which is hereby incorporated by reference.

The hydrocarbon conversion process with the first reforming catalyst is carried out in the presence of hydrogen at a pressure adjusted so as to favor the dehydrogenation reaction thermodynamically and limit undesirable hydrocracking reaction by kinetic means. The pressures used vary from 15 psig to 500 psig, and are preferably between from about 50 psig to about 300 psig; the molar ratio of hydrogen to hydrocarbons preferably being from 1:1 to 10:1, more preferably from 2:1 to 6:1.

The sulfur conversion reaction occurs with acceptable speed and selectivity in the temperature range of from 300° C. to 500° C. Therefore, the first reforming reactor is preferably operated at a temperature in the range of between about 350° C. and 480° C. which is known as mild reforming conditions.

When the operating temperature of the first reactor is more than about 300° C., the sulfur conversion reaction speed is sufficient to accomplish the desired reactions. At higher temperatures, such as 400° C. or more, some reforming reactions, particularly dehydrogenation of naphthenes, begin to accompany the sulfur conversion. These reforming reactions are endothermic and can result in a temperature drop of 10°-50° C. as the stream passes through the first reactor. When the operating temperature of the first reactor is above 500° C., an unnecessarily large amount of reforming takes place which is accompanied by hydrocracking and coking. In order to minimize these undesirable side reactions, we limit the first reactor temperature to about 500° C. or preferably 480° C. The liquid hourly space velocity of the hydrocarbons in the first reforming reactor reaction is preferably between 3 and 15.

Reforming catalysts have varying sensitivities to sulfur in the feedstream. Some reforming catalysts are less sensitive, and do not show substantially reduced activity if the sulfur level is kept below about 5 ppm. When they are deactivated by sulfur and coke buildup they can generally be regenerated by burning off the sulfur and coke deposits. Preferably the first refoming catalyst is this type.

SULFUR SORBENT

The effluent from the first reforming step, hereinafter the "first effluent", is then contacted with a sulfur sorbent. This sulfur sorbent must be capable of removing the $H_2S$ from the first effluent to less than 0.1 ppm at mild reforming temperatures, about: 300° C. to 450° C. Several sulfur sorbents are known to work well at these temperatures. The sorbent reduces the amount of sulfur in the feedstream to amounts less than 0.1 ppm, thereby producing what will hereinafter be referred to as the "second effluent". The water level should be kept fairly low preferably less than 100 ppm, and more preferably to less than 50 ppm in the hydrogen recycle stream.

The sulfur sorbent of this invention will contain a metal that readily reacts to form a metal sulfide supported by a refractory inorganic oxide or carbon support. Preferable metals include zinc, molybdenum, cobalt, tungsten, potassium, sodium, calcium, barium, and the like. The support preferred for potassium, sodium, calcium and barium is the refractory inorganic oxides, for example, alumina, silica, boria, magnesia, titania, and the like. In addition, zinc can be supported on fibrous magnesium silicate clays, such as attapulgite, sepiolite, and palygorskite. A particularly preferred support is one of attapulgite clay with about 5 to 30 weight percent binder oxide added for increased crush strength. Binder oxides can include refractory inorganic oxides, for example, alumina, silica, titania and magnesia.

A preferred sulfur sorbent of this invention will be a support containing between 20 and 40 weight percent of the metal. The metal can be placed on the support in any conventional manner, such as impregnation. But the preferred method is to mull a metal-containing compound with the support to form an extrudable paste. The paste is extruded and the extrudate is dried and calcined. Typical metal compounds that can be used are the metal carbonates which decompose to form the oxide upon calcining.

The effluent from the sulfur sorber, which is the vessel containing the sulfur sorbent, hereinafter the second effluent, will contain less than 0.1 ppm sulfur and preferably less than 0.05 ppm sulfur. The sulfur levels can be maintained as low a 0.05 ppm for long periods of time. Since both the less sulfur sensitive reforming catalyst and the solid sulfur sorbent can be nearly the same size, a possible and preferred embodiment of this invention is that the less sulfur sensitive reforming catalyst and the solid sulfur sorbent are layered intermixed in the same reactor. Then the thiophene sulfur can be converted to hydrogen sulfide and removed in a single process unit.

In one embodiment, more than one sulfur sorbent is used. In this embodiment, a first sulfur sorbent, such as zinc or zinc oxide on a carrier to produce a sulfur-lean effluent, then a second sulfur sorbent, such as a metal compound of Group IA or Group IIA metal is used to reduce the hydrogen sulfide level of the effluent to below 50 ppb, then the effluent is contacted with the highly selective reforming catalyst.

THE MORE SELECTIVE REFORMING CATALYSTS

The second effluent is contacted with a more selective and more sulfur sensitive reforming catalyst at higher temperatures typical of reforming units. The paraffinic components of the feedstock are cyclized and aromatized while in contact with this more selective reforming catalyst. The removal of sulfur from the feed stream in the first two steps of this invention make it possible to attain a much longer life than is possible without sulfur protection.

The more selective reforming catalyst of this invention is a large-pore zeolite charged with one or more dehydrogenating constituents. The term "large-pore zeolite" is defined as a zeolite having an effective pore diameter of 6 to 15 Ångstroms.

Among the large-pore crystalline zeolites which have been found to be useful in the practice of the present invention, type L zeolite, zeolite X , zeolite Y and faujasite are the most important and have apparent pore sizes on the order to 7 to 9 Ångstroms.

A composition of type L zeolite, expressed in terms of mole ratios of oxides, may be represented as follows:

$$(0.9\text{-}1.3)M_{2/n}O:Al_2O_3(5.2\text{-}6.9)SiO_2:yH_2O$$

wherein M designates a cation, n represents the valence of M and y may be any value from 0 to about 9. Zeolite L., its X-ray diffraction pattern, its properties, and method for its preparation are described in detail in U.S. Pat. No. 3,216,789. The real formula may vary without changing the crystalline structure; for example, the mole ratio of silicon to aluminum (Si/Al) may vary from 1.0 to 3.5.

The chemical formula for zeolite Y expressed in terms of mole ratios of oxides may be written as:

$$(0.7\text{-}1.1)Na_2O:Al_2O_3:xSiO_2:yH_2O$$

wherein x is a value greater than 3 up to about 6 and Y may be a value up to about 9. Zeolite Y has characteristic X-ray powder-diffraction pattern which may be employed with the above formula for identification. Zeolite Y is described in more detail in U.S. Pat. No. 3,130,007 is hereby incorporated by reference to show a zeolite useful in the present invention.

Zeolite X is a synthetic crystalline zeolitic molecular sieve which may be represented by the formula:

$$(0.7\text{-}1.1)M_{2/n}O:Al_2O_3:(2.0\text{-}3.0)\ SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244.

It is preferred that the more sulfur sensitive reforming catalyst of this invention is a type L zeolite charged with one or more dehydrogenating constituents.

A preferred element of the present invention is the presence of an alkaline earth metal in the large-pore zeolite. That alkaline earth metal may be either barium, strontium or calcium, preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in the catalyst because it promotes cracking, resulting in lower selectivity.

In one embodiment, at least part of the alkali metal is exchanged with barium, using techniques known for ion exchange of zeolites. This involves contacting the zeolite with a solution containing excess $Ba^{++}$ ions. The barium should constitute from 0.1% to 35% of the weight of the zeolite.

The large-pore zeolitic dehydrocyclization catalysts according to the invention are charged with one or more Group VIII metals, e.g., nickel, ruthenium, rhodium, palladium, iridium or platinum.

The preferred Group VIII metals are iridium and particularly platinum, which are more selective with regard to dehydrocyclization and are also more stable under the dehydrocyclization reaction conditions than other Group VIII metals.

The preferred percentage of platinum in the dehydrocyclization catalyst is between 0.1% and 5%, preferably from 0.2% to 1%.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

EXAMPLE 1

This is an example of the present invention. A feedstock containing measured amounts of various impurities was passed over a reforming catalyst and then a sulfur sorbent. The less sensitive reforming catalyst was made by the method of U.S. Pat. No. 3,415,737.

The sulfur sorbent was prepared by mixing 150 grams alumina with 450 grams attapulgite clay, adding 800 grams zinc carbonate, and mixing dry powders together. Enough water was added to the mixture to make a mixable paste which wa then extruded. The resulting extrudate was dried and calcined.

The sulfur sorbent had properties as follows:

| | |
|---|---|
| Bulk density | 0.70 gm/cc |
| Pore volume | 0.60 cc/gm |
| $N_2$ surface area | 86 $m^2$/gm; and |
| Crush strength | 1.5 lbs/mm. |

The final catalyst contained approxiamately 40 wt. % zinc as metal.

A reformer feed was first contacted with the less sensitive reforming catalyst and then with the sulfur sorber. Thiophene was added to a sulfur free feed to bring the sulfur level to about 10 ppm. The product from the sulfur sorber was analyzed for sulfur. If the level was below 0.1 ppm it could have been used as feed for a more sulfur sensitive reforming catalyst.

The data is tabulated on Table I.

TABLE I

| DAY | FEED SULFUR (PPM) | 1ST REACTOR TEMPERATURE °F. | 2ND REACTOR TEMPERATURE °F. | SULFUR (PPM) ANALYSIS |
|---|---|---|---|---|
| 1-7 | 11.7 | 850 (454° C.) | 650 (343° C.) | 0.05 |
| 7-9 | 7.2 | 850 (454° C.) | 650 (343° C.) | <0.04 |
| 9-12 | 8.0 | 850 (454° C.) | 650 (343° C.) | <0.05 |
| 13 | 10.5 | 850 (454° C.) | 650 (343° C.) | 0.06 |
| 14-15 | 10.5 | 850 (454° C.) | 700 (370° C.) | |
| 16 | 10.5 | 800 (425° C.) | 700 (370° C.) | 0.04 |
| 17-19 | 10.5 | 750 (400° C.) | 700 (370° C.) | 0.04 |
| 20-21 | 10.5 | 700 (370° C.) | 700 (370° C.) | |
| 22-23 | 8.6 | 700 (370° C.) | 700 (370° C.) | <0.04 |
| 24-28 | 8.4 | 700 (370° C.) | 700 (370° C.) | <0.04 |

EXAMPLE 2

A small hydroprocessing reactor was set up containing: 25 cubic centimeters of a mixture of platinum on alumina, as the less sensitive reforming catalyst, and zinc oxide on alumina, as the sulfur sorbent. The effluent from this reactor was passed over 100 cc of L zeolite that had been barium exchanged, which is a highly selective, but very sulfur sensitive reforming catalyst. The feedstock was a light naphtha feedstock. The results are shown in Table II. One ppm sulfur was added to the feed at 30 hours. The temperature was increased to provide a total $C_5$+ yield of 88.5 volume percent.

TABLE II

| Hours of Operation | Temperature °F. |
|---|---|
| 200 | 855 |
| 400 | 860 |
| 600 | 860 |
| 800 | 870 |
| 1000 | 875 |
| 1200 | 875 |

COMPARATIVE EXAMPLE

When the same L zeolite reforming catalyst is use during the presence of sulfur, it is rapidly deactivated. The temperature was to be adjusted upwards to maintain a constant $C_5$+ make, but 0.5 ppm sulfur was added at 270 to 360 hours on stream, and no sulfur protection was present. The reforming catalyst deactivated so rapidly that after 450 hours it was no longer possible to maintain a constant $C_5$+ make. The results are shown in Table III.

TABLE III

| Run time, Hrs. | in Liquid, Temperature, °F. | $C_5$+ Yield LV % |
|---|---|---|
| 200 | 862 | 84.2 |

TABLE III-continued

| Run time, Hrs. | in Liquid, Temperature, °F. | $C_5$+ Yield LV % |
|---|---|---|
| 300 | 864 | 85.0 |
| 350 | 876 | 85.6 |
| 400 | 887 | 85.6 |
| 450 | 896 | 85.5 |
| 500 | 904 | 85.8 |

The comparison shows how totally this invention protects the more sulfur sensitive catalyst adding greatly to its life.

The preceding examples are illustrative of preferred embodiments of this invention, and are not intended to narrow the scope of the appended claims.

What is claimed is:

1. A method for removing residual sulfur from a hydrotreated naphtha feedstock containing organic sulfur compounds and for reforming the naphtha feedstock, comprising:

(a) contacting said feedstock, in the presence of hydrogen, with a less sulfur sensitive reforming catalyst, which comprises platinum on alumina; to conduct some reforming reactions and to convert the organic sulfur compounds to $H_2S$ without substantially hydrocracking the naphtha feedstock, at a temperature lower than 480° C.; a pressure between 50 and 300 psig; a hydrogen recycle ratio between 2:1 and 6:1 $H_2$/HC; and a space velocity between 3 and 15 LHSV, thereby forming a first effluent;

(b) contacting the first effluent with a solid sulfur sorbent comprising potassium on alumina, at a temperature between 300° C. and 450° C. to remove $H_2S$ to less than 0.05 ppm thereby forming a second effluent; and (c) contacting the second effluent, under reforming conditions, with a highly selective and highly sensitive sulfur reforming catalyst.

* * * * *